US010836060B2

(12) United States Patent
Squires et al.

(10) Patent No.: US 10,836,060 B2
(45) Date of Patent: Nov. 17, 2020

(54) SPACER FOR RAZOR

(71) Applicants: Blake Squires, Akron, OH (US); John D. Osher, Fort Lauderdale, FL (US)

(72) Inventors: Blake Squires, Akron, OH (US); John D. Osher, Fort Lauderdale, FL (US)

( * ) Notice: Subject to any disclaimer, the term of this patent is extended or adjusted under 35 U.S.C. 154(b) by 0 days.

(21) Appl. No.: 16/531,907

(22) Filed: Aug. 5, 2019

(65) Prior Publication Data

US 2019/0351569 A1 Nov. 21, 2019

Related U.S. Application Data

(63) Continuation of application No. 15/489,838, filed on Apr. 18, 2017, now Pat. No. 10,369,713.

(60) Provisional application No. 62/325,545, filed on Apr. 21, 2016, provisional application No. 62/410,591, filed on Oct. 20, 2016.

(51) Int. Cl.

| | |
|---|---|
| ***B26B 21/40*** | (2006.01) |
| ***B26B 21/52*** | (2006.01) |
| ***B26B 21/22*** | (2006.01) |
| ***B26B 21/42*** | (2006.01) |

(52) U.S. Cl.

CPC ..... *B26B 21/4037* (2013.01); *B26B 21/225* (2013.01); *B26B 21/227* (2013.01); *B26B 21/4006* (2013.01); *B26B 21/42* (2013.01); *B26B 21/522* (2013.01)

(58) Field of Classification Search

CPC ... B26B 21/42; B26B 21/227; B26B 21/4037; B26B 21/40; B26B 21/22; B26B 21/52; B26B 21/522; B26B 21/225; B26B 21/4006

USPC ..... 30/537–541, 47–51

See application file for complete search history.

(56) References Cited

U.S. PATENT DOCUMENTS

| | | | |
|---|---|---|---|
| 797,184 | A | 8/1905 | Deneen |
| 1,333,315 | A | 3/1920 | Jacquat |
| 1,419,187 | A | 6/1922 | Wilson |
| 1,493,962 | A | 5/1924 | Cowan |
| 1,897,982 | A | 2/1933 | Jones |
| 2,046,006 | A | 7/1936 | Taylor |
| 2,165,391 | A | 7/1939 | Lewis |
| 2,171,880 | A | 9/1939 | Lewis |
| D123,180 | S | 10/1940 | Pileggi |
| 2,234,440 | A | 3/1941 | Lewis |
| 2,237,676 | A | 4/1941 | Lewis |
| 2,612,684 | A | 10/1952 | Mansfield |
| 2,634,496 | A | 4/1953 | Halen |
| 2,670,522 | A | 3/1954 | Kearney |

(Continued)

FOREIGN PATENT DOCUMENTS

| | | |
|---|---|---|
| FR | 2833815 | 6/2003 |
| FR | 2918305 | 1/2009 |

(Continued)

*Primary Examiner* — Ghassem Alie
*Assistant Examiner* — Nhat Chieu Q Do
(74) *Attorney, Agent, or Firm* — Walter | Haverfield LLP; James J. Pingor

(57) ABSTRACT

A razor blade assembly has a handle, a head having a cutting blade assembly of one or more cutting blades connected to the handle; and a spacer which is mounted to or is formed as part of the head to space the cutting edges of the blades from the skin of a user to create and maintain a 5 o'clock shadow appearance beard in the range of 0.1 mm to 0.4 mm in thickness.

9 Claims, 8 Drawing Sheets

(56) References Cited

U.S. PATENT DOCUMENTS

| | | | | |
|---|---|---|---|---|
| 3,008,233 | A * | 11/1961 | Waggoner | B26B 19/3813 30/537 |
| 3,172,202 | A | 3/1965 | Sooter | |
| 3,183,589 | A | 5/1965 | Szabo | |
| 3,203,093 | A | 8/1965 | Kuhnl | |
| 3,219,180 | A | 11/1965 | Rosen | |
| D205,453 | S | 8/1966 | Christensen | |
| 3,263,328 | A | 8/1966 | Craig | |
| 3,289,295 | A | 12/1966 | Tronvall | |
| D210,713 | S | 4/1968 | Hamill | |
| 3,388,468 | A | 6/1968 | Hamill | |
| D226,642 | S | 4/1973 | Ferrier | |
| 3,816,913 | A | 6/1974 | Ferraro | |
| 3,816,916 | A | 7/1974 | Kuhnl | |
| 3,909,942 | A | 10/1975 | Ciaffone | |
| 3,964,159 | A | 6/1976 | Ferraro | |
| 3,986,258 | A | 10/1976 | Liedtke | |
| 4,094,066 | A | 6/1978 | Daniel | |
| 4,265,105 | A | 5/1981 | Asano | |
| 4,345,374 | A | 8/1982 | Jacobson | |
| 4,346,721 | A | 8/1982 | Molaro | |
| 4,476,630 | A | 10/1984 | Byrne | |
| 4,663,841 | A | 5/1987 | Custer | |
| 4,709,476 | A | 12/1987 | Shurtleff | |
| 4,724,614 | A | 2/1988 | Wahl | |
| D312,144 | S | 11/1990 | Buba | |
| 5,095,621 | A | 3/1992 | Rapp | |
| 5,386,750 | A | 2/1995 | Morrison | |
| 5,388,332 | A | 2/1995 | Oldroyd | |
| 5,410,810 | A | 5/1995 | Gillibrand | |
| 5,771,592 | A | 6/1998 | Nizker | |
| 5,813,293 | A | 9/1998 | Apprille | |
| 5,893,213 | A | 4/1999 | Motta | |
| 6,094,820 | A | 8/2000 | Adachi | |
| 6,185,827 | B1 | 2/2001 | Polites | |
| 6,249,973 | B1 | 6/2001 | Hirano | |
| D449,710 | S | 10/2001 | Wonderley | |
| 6,539,633 | B1 | 4/2003 | Rebaudieres | |
| D499,511 | S | 12/2004 | Wakayama | |
| D509,322 | S | 9/2005 | Wonderley | |
| D541,987 | S | 5/2007 | Sugawara | |
| 7,322,109 | B2 | 1/2008 | Newkirk | |
| D568,534 | S | 5/2008 | Micinilio | |
| D602,634 | S | 10/2009 | Cataudella | |
| D616,147 | S | 5/2010 | Adams | |
| D616,148 | S | 5/2010 | Wonderley | |
| D616,149 | S | 5/2010 | Wonderley | |
| D616,606 | S | 5/2010 | Adams | |
| D617,497 | S | 6/2010 | Goodhead | |
| D619,300 | S | 7/2010 | Wonderley | |
| D619,301 | S | 7/2010 | Wattam | |
| D620,196 | S | 7/2010 | Nicoll | |
| D624,242 | S | 9/2010 | Bridges | |
| D630,377 | S | 1/2011 | Wattam | |
| 7,954,244 | B2 | 6/2011 | Orloff | |
| 8,015,710 | B1 | 9/2011 | Zyla | |
| 8,739,411 | B2 | 6/2014 | Kinghorn | |
| 9,751,226 | B2 | 9/2017 | Psimadas | |
| 9,919,441 | B2 | 3/2018 | Drori | |
| 10,144,142 | B1 | 12/2018 | Squires | |
| 10,369,713 | B1 | 8/2019 | Squires | |
| 2002/0083600 | A1 | 7/2002 | Donovan | |
| 2004/0103538 | A1 | 6/2004 | Dansreau | |
| 2005/0066527 | A1 | 3/2005 | Wakayama | |
| 2008/0250644 | A1 * | 10/2008 | Orloff | B26B 21/42 30/34.1 |
| 2009/0007442 | A1 | 1/2009 | Kurihara | |
| 2010/0011586 | A1 | 1/2010 | Nicoll | |
| 2010/0058595 | A1 | 3/2010 | Walker | |
| 2011/0094108 | A1 | 4/2011 | Wain | |
| 2011/0203124 | A1 | 8/2011 | Bridges | |
| 2011/0225833 | A1 | 9/2011 | Hoffman | |
| 2012/0137524 | A1 * | 6/2012 | Mikula | B26B 19/20 30/34.1 |
| 2013/0199346 | A1 | 8/2013 | Psimadas | |
| 2016/0318198 | A1 | 11/2016 | Brazley | |
| 2017/0197322 | A1 * | 7/2017 | Drori | B26B 21/42 |
| 2017/0210020 | A1 | 7/2017 | Bozikis | |
| 2017/0266826 | A1 | 9/2017 | Kole | |
| 2018/0333879 | A1 | 11/2018 | Squires | |
| 2019/0077034 | A1 | 3/2019 | Squires et al. | |

FOREIGN PATENT DOCUMENTS

| | | |
|---|---|---|
| GB | 2461337 | 1/2010 |
| WO | 2006108175 | 10/2006 |
| WO | 2010003510 | 1/2010 |
| WO | 2016036238 | 3/2016 |
| WO | 2017137849 | 8/2017 |

* cited by examiner

SPACER FOR RAZOR

CROSS-REFERENCE TO RELATED APPLICATIONS

This application is a continuation of, and claims the priority of, U.S. patent application Ser. No. 15/489,838, filed Apr. 18, 2017, and entitled "SPACER FOR RAZOR BLADE FOR CREATING AND MAINTAINING A 5 O'CLOCK SHADOW SHAVE," which claims the benefit of U.S. Provisional Patent Application Ser. No. 62/410,591 entitled "ADJUSTABLE RAZOR" filed on Oct. 20, 2016, and also claims the benefit of U.S. Provisional Patent Application Ser. No. 62/325,545 entitled "ADJUSTABLE RAZOR" filed on Apr. 21, 2016. The entirety of the above-noted applications are incorporated by reference herein.

BACKGROUND OF THE DISCLOSURE

The present exemplary embodiment relates to razor blades for shaving. More particularly, it relates to a razor which has a blade that can adjusted or spaced from the user's skin to create and maintain a "5 o'clock shadow" appearance without the need to grow a beard and then shave it off every several days.

Existing disposable razors employ fixed blades which have a predetermined depth to obtain a "clean shave", Electric trimmers, on the other hand, often employ mechanisms by which to adjust the trimmer depth to obtain a desired depth or hair length.

In today's society, three of the most common and popular shaved appearances are shown in FIG. 1: A clean shave (CS), A "5 o'clock shadow" (SH) with a small amount of facial hair, and a bearded shave (BE) with a greater amount of facial hair. In the last ten years or so, it has become extremely popular for men, particularly young men between the ages of 18-34 such as actors, models, athletes, musicians, celebrities, etc. to sport a "5 o'clock shadow" appearance where they have a slight amount of facial hair that is always carefully groomed in appearance.

A problem with maintaining this look is it requires the man to grow a beard for three or four days and then shave it off every few days, and let it start to grow back until the desired appearance is achieved. This can be time consuming and frustrating for the man to maintain a consistent and carefully groomed 5 o'clock shadow appearance.

Another problem with maintaining a 5 o'clock shadow look is there is currently no existing low cost option is to create a "5 o'clock shadow" appearance such as by using a manual razor. Rather, an electric trimmer could possibly create a look similar to the "5 o'clock shadow" appearance; however, electric trimmers are costly with no lower cost alternative available. Also, electric trimmers may not be able to provide a wide range of consistent "5 o'clock shadow" shaves. Another problem with electric trimmers is they may also create "bald spots" on the user's face if they shave the user's face too closely.

Thus, there is a need for a manual, low cost device whereby a blade depth can be easily created and maintained by a replaceable cap or spacer or a permanent spacer which is attached to a razor blade to create and consistently maintain a "5 o'clock shadow" appearance.

SUMMARY OF THE DISCLOSURE

The present disclosure relates to razor blades. More particularly, it relates to a cap or spacer which is used to adjust the blade depth by spacing the blade from the user's skin to create and maintain a consistent "5 o'clock shadow" appearance.

In accordance with a preferred embodiment of the disclosure, a razor blade assembly includes a handle; a head having a cutting blade assembly having one or more cutting blades connected to the handle; and the head has a spacer to create and maintain a "5 o'clock shadow" preferably in the range of 0.1 mm to 0.4 mm in thickness. An optimum thickness is preferably 0.35 mm thickness.

In accordance with another embodiment of the disclosure, a cap or spacer for adjusting blade thickness of a razor blade has a body having first and second side walls, a rear wall and a front wall connected to the first and second side walls; a first protruding or top wall extending from the rear wall and second protruding or bottom wall extending from the front wall, and a plurality of ribs extending between the rear wall and the front wall. The ribs are positioned above the cutting edges of the razor blades and space the razor blade cutting edge a predetermined distance from a surface (i.e., the user's skin) to be shaved.

In accordance with another embodiment of the disclosure, a method of creating and maintaining a 5 o'clock shadow shave appearance on the skin of user includes: providing a razor blade assembly having a handle and a head comprising a plurality of blades; providing a cap or spacer which is mounted to and positioned over the head to space the cutting edges of the blades from the skin to create and maintain a 5 o'clock shadow shave appearance in the range of 0.1 mm thickness to 0.4 mm beard thickness.

Thus, in accordance with one embodiment of the disclosure, a razor blade is provided with caps or spacers which can be permanently or removably attached to a blade receiver portion of a razor thereby controlling or otherwise limiting the depth of the blade relative to a shaving surface (e.g. 0.1 mm, 0.2 mm, 0.3 mm, 0.4 mm, etc.).

In accordance with another embodiment of the disclosure, the razor blades can create and maintain a close "5 o'clock shadow" appearance in the range of about 0.1 mm to 0.4 mm in beard thickness.

In accordance with another embodiment of the disclosure, a removable cap is provided for a manual, disposable razor.

In accordance with another embodiment of the disclosure, the razor blade and cap can be used in a dry shave scenario wherein no creams are used since the blade does not actually contact the skin.

In accordance with another embodiment of the disclosure, the blade cap can be adjusted to fit on virtually any commercially available razor blade.

In accordance with another embodiment of the disclosure, a razor blade kit is provided which includes a razor handle, blades, and interchangeable caps of various thickness dimensions.

In accordance with another embodiment of the disclosure, the caps can be removably attached such as being snapped and or clicked onto the blade body.

In accordance with another embodiment of the disclosure, the razor cap can be used with cream, oil, foam or lotion to form a very close shave such as 0.1 mm.

In accordance with another embodiment of the disclosure, a razor blade with an integral spacer or cap which is disposable after use can be provided.

Still other aspects of the disclosure will become apparent upon a reading and understanding of the following detailed description.

DETAILED DESCRIPTION OF THE DISCLOSURE

With reference now to FIGS. 2-11, 14 and 15, a preferred embodiment of a razor blade cap is shown and described. The Figures illustrate a preferred embodiment of the disclosure only is not limited to the embodiments of the Figures. Variations and modifications are contemplated by the disclosure.

Figure 1:
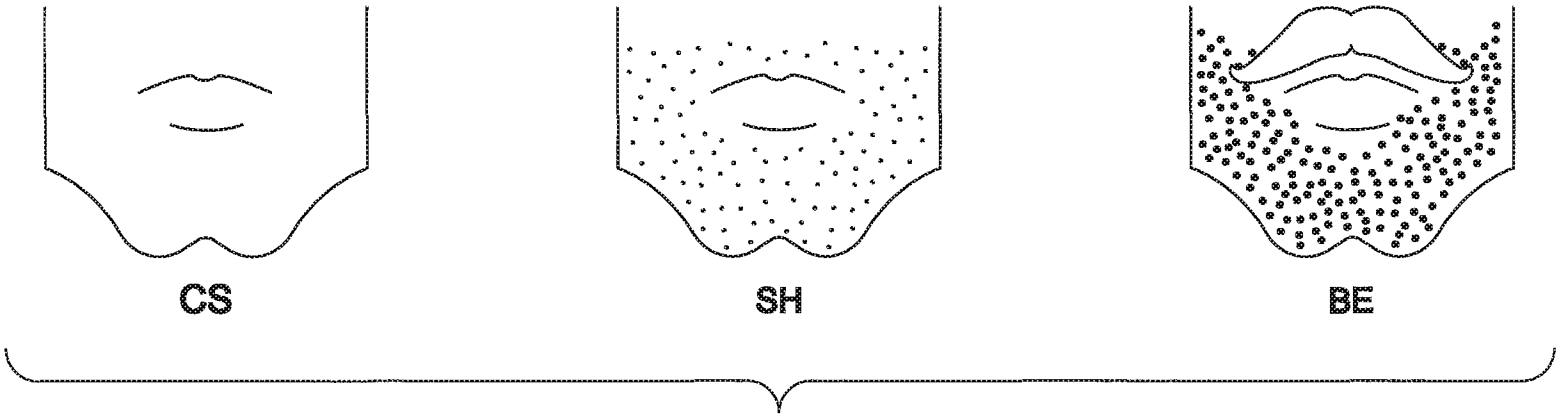
FIG. 1 illustrates a man with a close shave, a "5 o'clock shadow" shave and a bearded shave.
Figure 2:
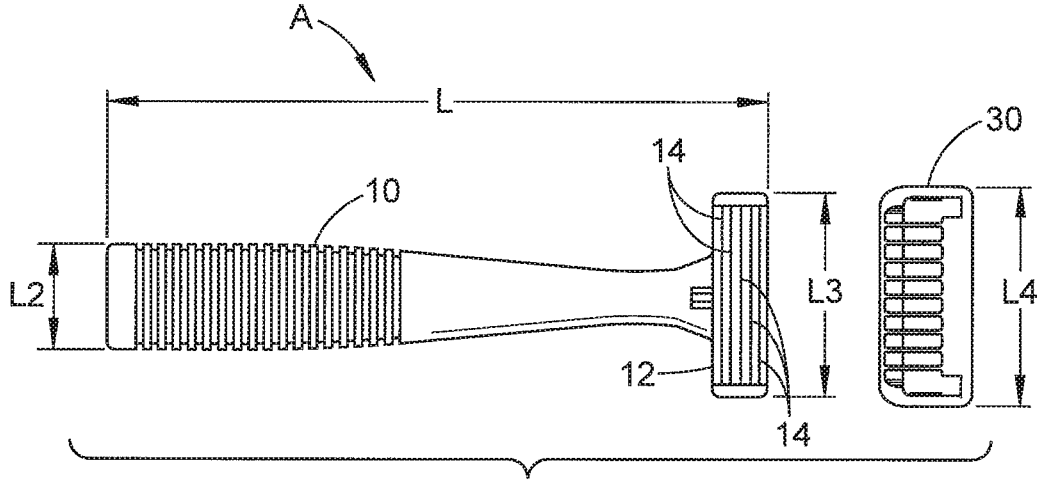
FIG. 2 is a top plan view of a razor blade and handle assembly and a cap in accordance with one embodiment of the disclosure.

Referring to FIG. 2, a disposable razor blade assembly A includes a handle 10 and a head 12 which receives razor blade(s) 14. The blade head is preferably snapped into and locks into the upper end of the handle using tabs 16 (FIG. 3) or other locking mechanisms may be snapped or moved to engage and disengage the blade head 12 from the handle 10.

The handle 10 may be rectangular or cylindrical in conformation and may taper from a narrow end 18 adjacent the blade head to a wider end 20 for gripping comfort.

Referring to FIG. 2, various dimensions for the razor blade assembly are contemplated. For example, the length L of the handle can be about 134 mm and length L2 of the wide end 20 may be about 22 mm. The blade head itself can be about 0.40 mm long (L3). One embodiment of a cap or spacer 30 preferably has a length L4 of about 0.45 mm.

Figure 3:
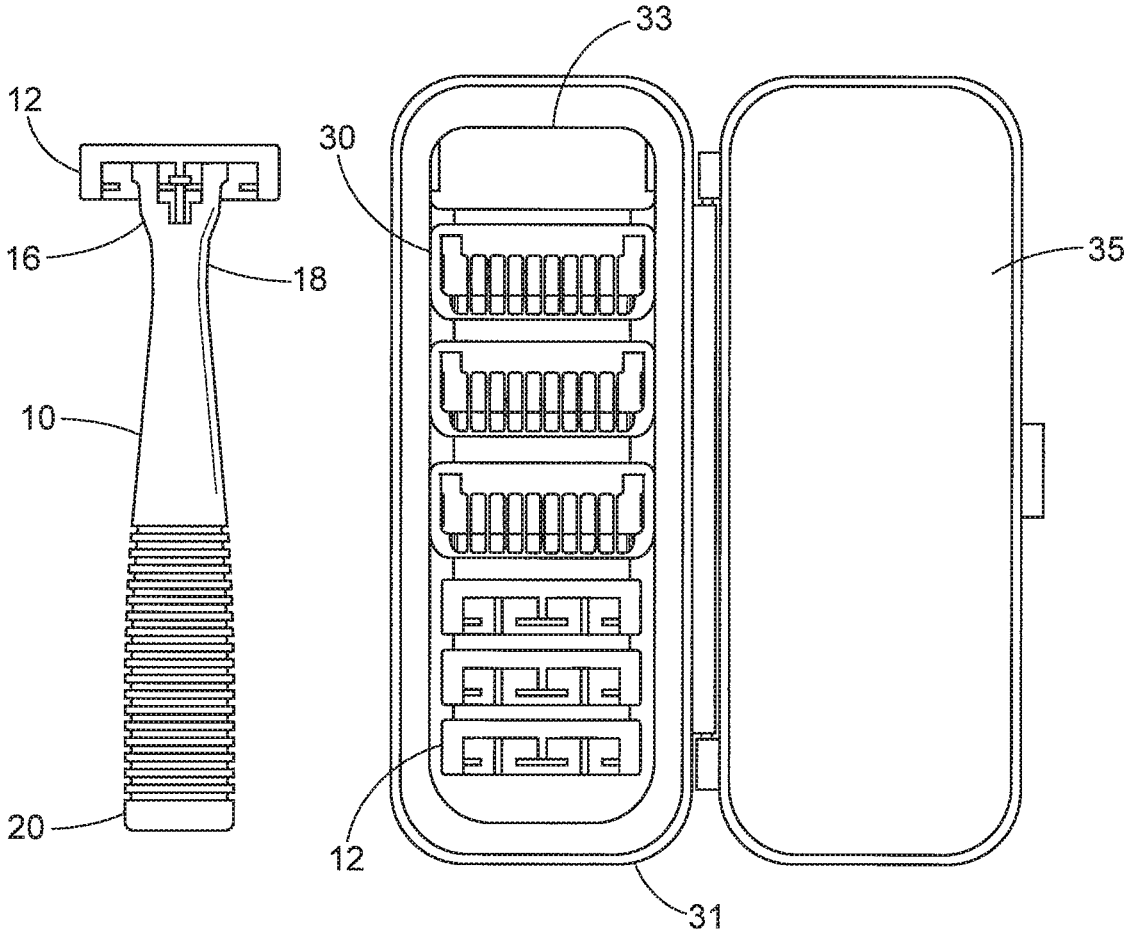
FIG. 3 is a top plan view of a carrying case and razor blade and cap in accordance with another embodiment of the disclosure.

Referring now to FIG. 3, a carrying case 33 such as with a clam-shell style plastic housing 31 with a hinged cover 35 is shown which can for example conveniently house the razor blade handle 10, three blade heads 12, and three or more caps 30, 32, 34.

Figure 4:
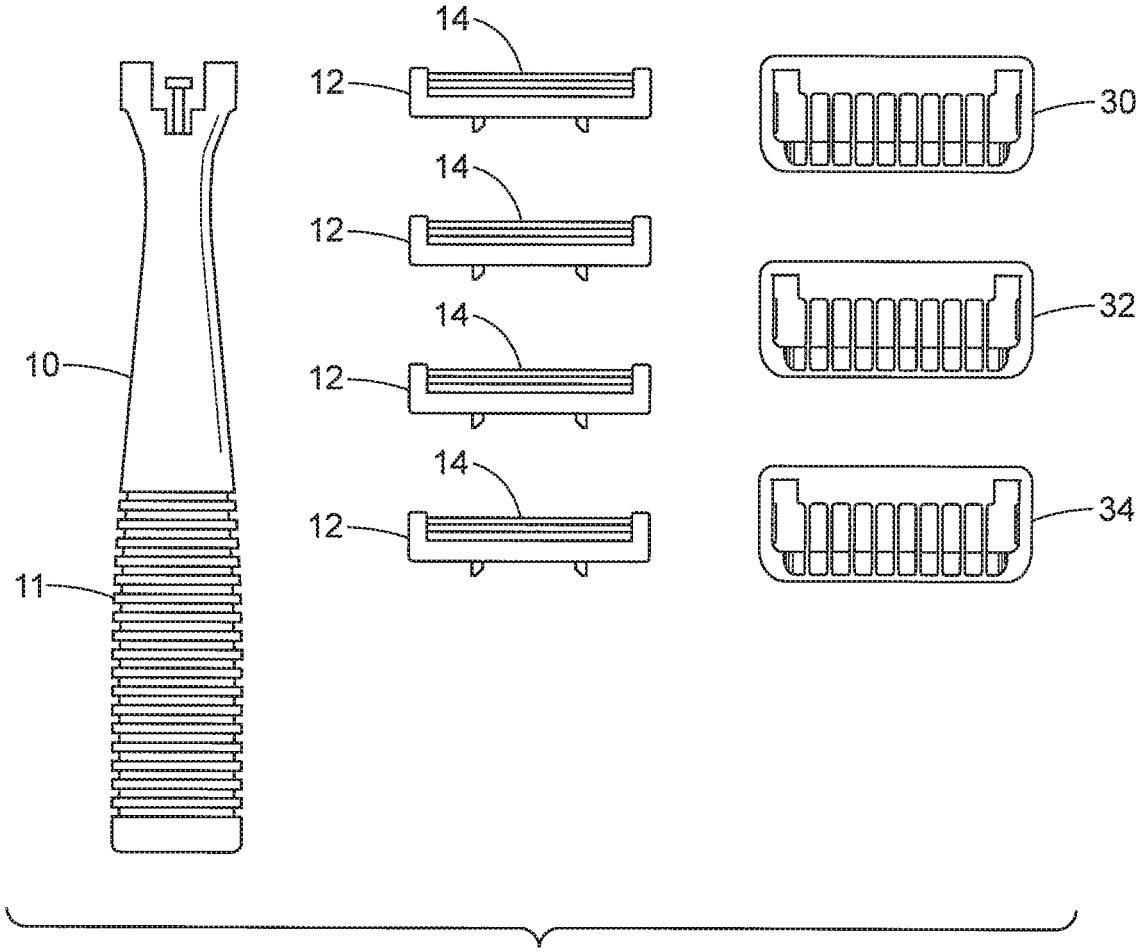
FIG. 4 is a top plan view of a handle, blades and caps in accordance with another embodiment of the disclosure

FIG. 4 illustrates the handle 10 which may have ridges or knurls 11 forming an improved ergonomic design for easy gripping, the blade heads 12, and three caps 30, 32, 34 of various gauges.

The caps can be provided in the same gauge or in different gauges. "Gauge" refers to the thickness of the desired shave; e.g., a 0.1 mm gauge refers to a 0.1 mm thickness beard, etc. As an example, cap 30 has gauge or thickness of 0.1 mm, cap 32 has a gauge of 0.2 mm, while cap 34 has a gauge of 0.4 mm. Other caps can have a gauge of 0.3, 0.35, etc. Many other gauges particularly in the range of 0.1 mm to 0.4 mm are contemplated by the disclosure.

For example, the 0.1 mm gauge cap 30 results in approximately a 0.1 mm thick beard since it spaces and positions the blades approximately 0.1 mm from the skin, the 0.2 mm gauge cap 32 provides an approximately 0.2 mm thick beard, while a 0.4 mm gauge cap 34 provides approximately a 0.4 mm thick beard, and so on. An optimum beard thickness would be around 0.35 mm thickness. The caps can be made of any suitable material, such as plastic or metal but slightly flexible plastic is preferred. The caps can be made from molds, extrusions or any suitable manufacturing method.

Referring now to FIGS. 5-11, the details of a preferred embodiment of cap 30 are shown and explained. Other caps 32, 34 will have essentially the same features except for the gauge or thickness. The cap 30 is a 0.1 mm gauge cap used for maintaining a 5 o'clock shadow which has an optimum beard or hair thickness of 0.1 mm. The cap has two side walls 36, 38 which are parallel to each other, a first or back wall 40 which is perpendicular to side walls 36, 38. A second or front wall 42 extends between walls 36, 38 and is perpendicular to walls 36, 38.

Side walls 36 and 38 are preferably tapered or angled resulting in wall 44 being positioned at an angle or slightly above wall 42. A plurality of cavities 45 are formed between walls 36, 38, 40, 42 and between ribs 50. An extension or top wall 44 extends from an upper end 46 of wall 40 between walls 36, 38, while a second extension or bottom wall 48 extends from bottom wall 42 between walls 36, 38. The protrusion walls 44, 48 add rigidity and may also aid in mounting the cap to the blade head. Wall 44 may also have wings or curved edges 47, 49 for added rigidity.

Figure 5:
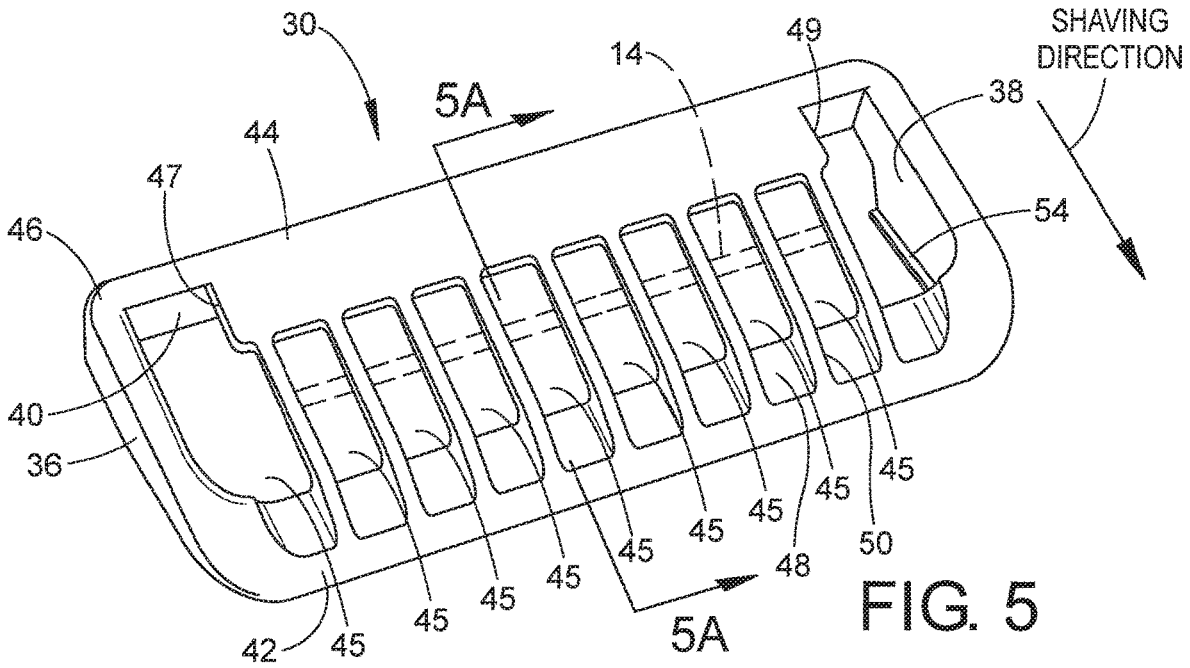
FIG. 5 is a perspective view of a blade cap positioned over a blade cutting edge in accordance with another embodiment of the disclosure.
Figure 5A:
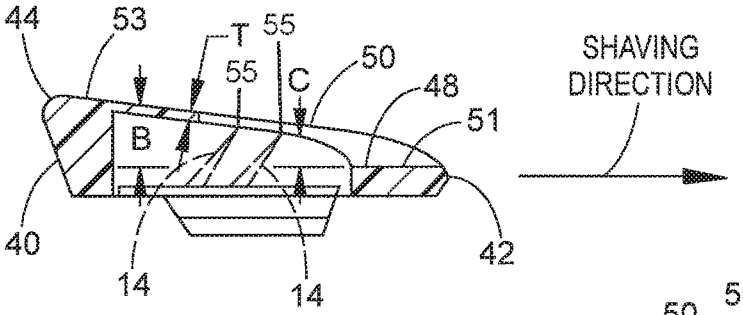
FIG. 5A is a cross-sectional view taken along line 5A of FIG. 5.
Figure 6:
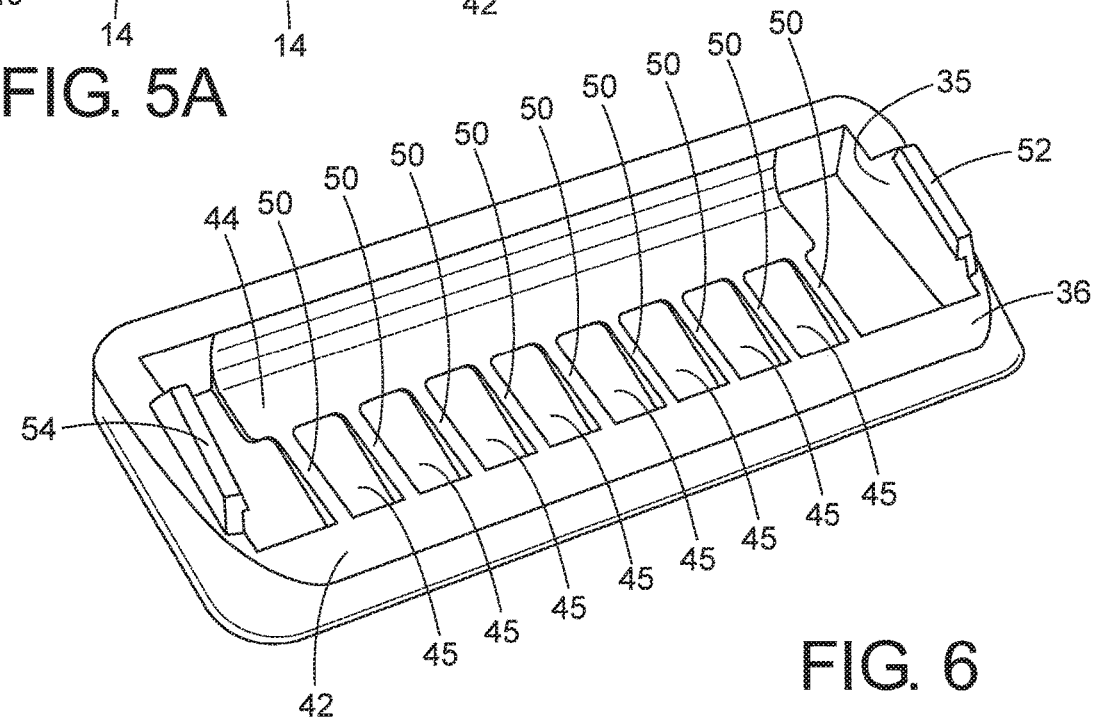
FIG. 6 is a bottom plan view of the blade cap of FIG. 5.
Figure 8:
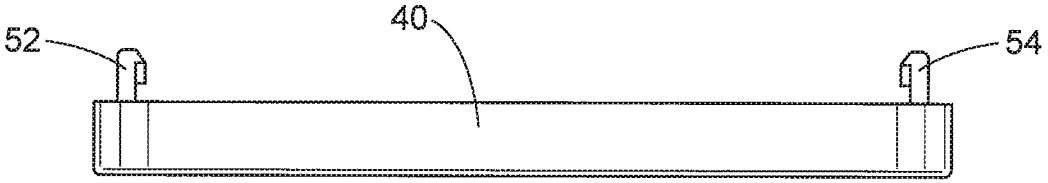
FIG. 8 is a rear elevational view of the cap of FIG. 5.
Figure 7:
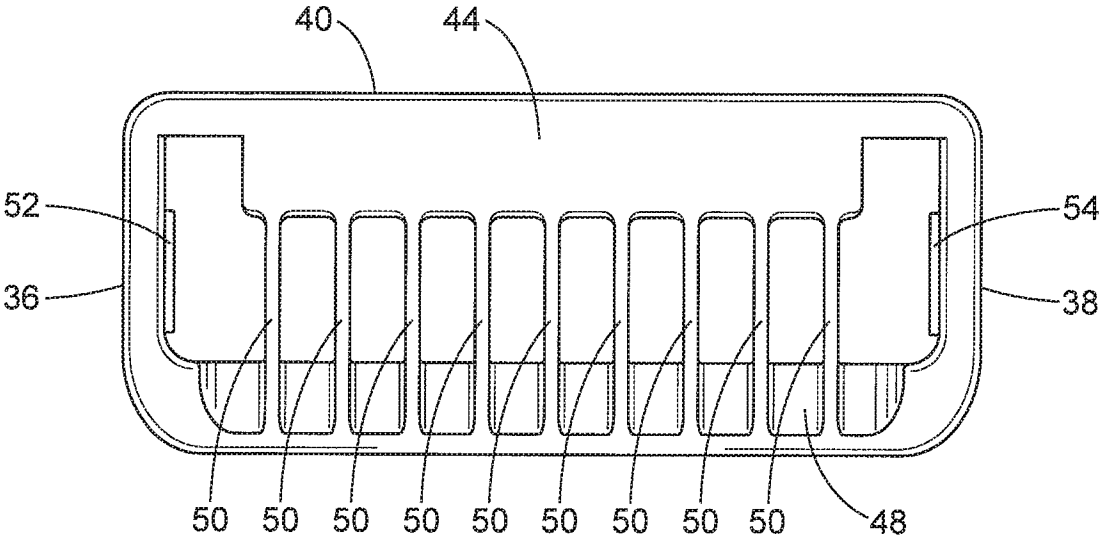
FIG. 7 is a top plan view of the cap of FIG. 5.
Figure 9:
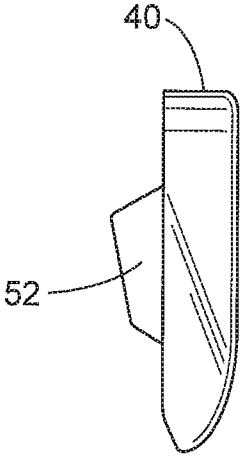
FIG. 9 is side elevational view of the cap of FIG. 5.
Figure 10:
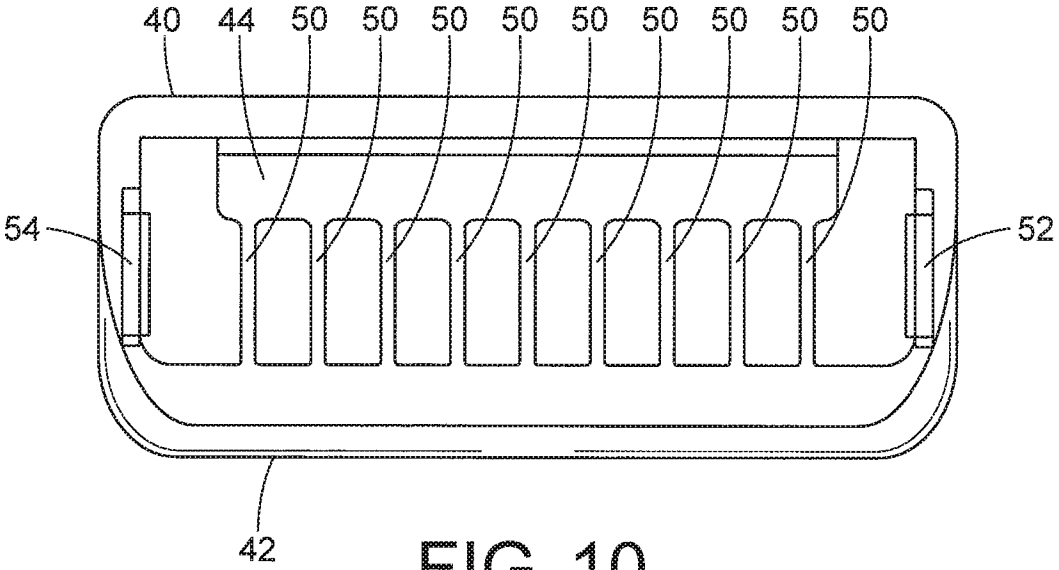
FIG. 10 is a bottom plan view of the cap of FIG. 5.
Figure 11:
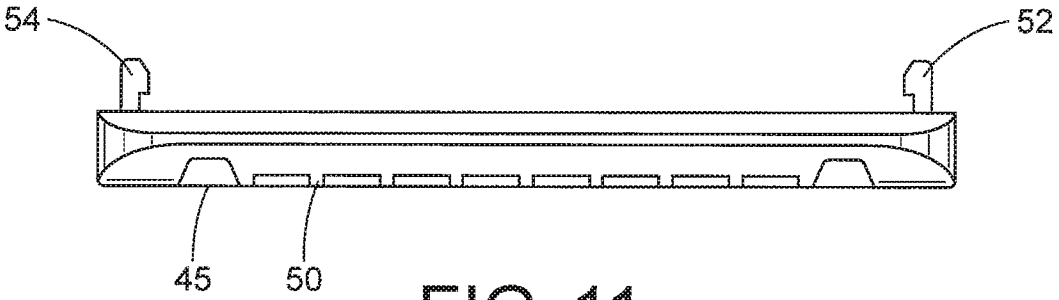
FIG. 11 is a front elevational view of the cap of FIG. 5.

Wall 48 serves as a facial hair receiving or entry surface. Referring to FIG. 5A, surface 51 of wall 48 is spaced or positioned below surface 53 of wall 44 by dimension "B" and below an upper cutting edge 55 of a cutting blade 14 by dimension "C". This allows the hair to be cut to not bend or get crimped by the edge of the cap and align the hair with and be engaged by the cutting edges 55 of blade 14. The ribs or facial hair guides 50 engages the skin of the face of the user, and serves to space the surface to be shaved from the blade cutting edge 55 to result in a specific hair length (referred to as gauge thickness). The shaving direction is shown in FIGS. 5 and 5A. The wall 44 can serve as a stop surface for preventing further cutting and also to facilitate removal of the cut hair from the face of the user.

Several ribs or facial hair guides 50 extend between and connect wall 44 and wall 48. The ribs may be chamfered and tapered between walls 44 and 48. Nine ribs are shown, but other numbers are contemplated by the disclosure. The ribs are shown as substantially equally spaced, but other spacing is contemplated by the disclosure. The ribs are substantially parallel to each other and form a grid and due to the thickness T of the ribs serve as a spacer for spacing the cutting edge 55 of the blade 14 from the user's skin. That is, the blades cutting edges are positioned below the ribs. Thus, the thicker the ribs, the thicker (i.e., higher gauge) the shave (i.e., the hair is longer). The thinner the ribs (i.e., lower gauge), the closer the shave (i.e., the hair is shorter). In this example, the ribs have a thickness T of about 0.1 mm to form a 0.1 mm thick beard which is referred to as a "5 o'clock shadow".

The ribs 50 of the cap thus are able to create and maintain a certain thickness of shave, commonly referred to as a "5 o'clock shadow". The optimum thickness for a 5 o'clock shadow appearance is in the range of 0.1 mm to 0.4 mm in thickness. Thus, the various thickness T of the ribs can be about 0.1 mm, 0.2 mm, 0.3 mm and 0.4 mm. Other thicknesses are contemplated by the disclosure.

The caps 30, 32, 34 have a gauge thickness ranging from 0.1 mm to 0.4 mm to create a "5 o'clock shadow". The caps can have various size grills and various numbers of ribs and may be configured to fit various blades such as two, three, four, five or six blades. FIGS. 7-11 show various views of the structure of the cap 30.

Two resiliently biased clips 52, 54 are formed on and protrude from opposite side walls 36, 38 for removably attaching the cap onto a blade by snapping or clicking the cap onto the sides of the blade head. The clips are slightly flexed outwardly and snap into place to retain the clip onto the blade itself. As an alternative, the cap can be formed as part of the head itself to provide a complete integral and disposable unit.

Figure 14:
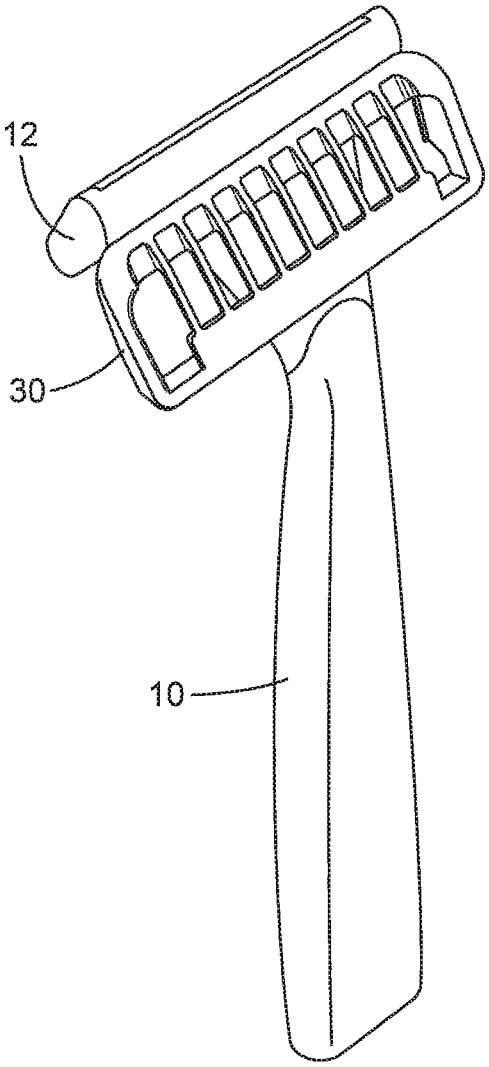
FIG. 14 is a perspective view of a cap installed on a razor blade in a storage position in accordance with another embodiment of the disclosure.
Figure 15:
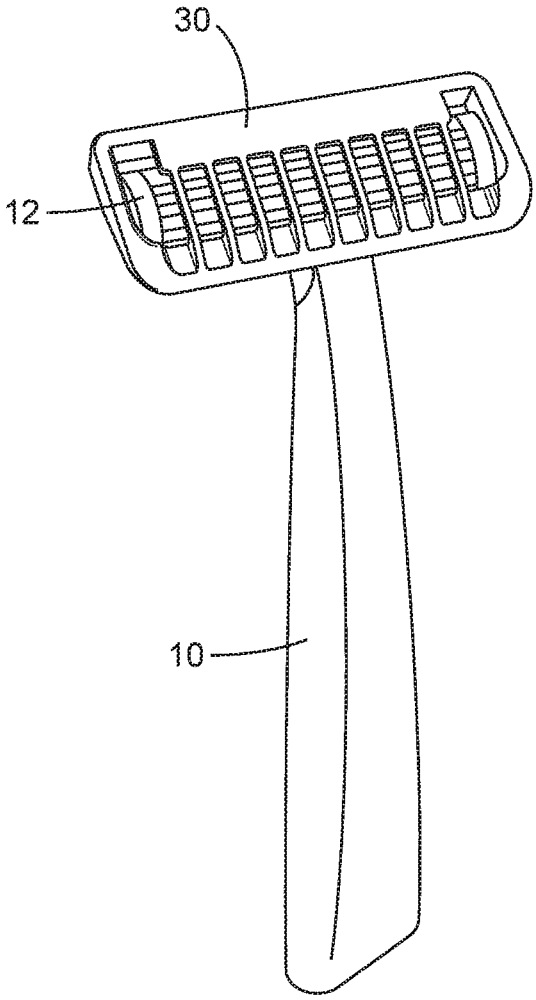
FIG. 15 is a perspective view of the cap installed on a razor blade in an in-use position in accordance with another embodiment of the disclosure.

By placing the cap directly on the blade head 12 directly above blades 14 (see FIG. 15), various thicknesses of shave can be easily obtained. Thus, there is no longer a need to grow a beard for one to three days and then shave it off and repeating the process to maintain the "5 o'clock shadow" look. The cap of the preferred embodiment allows the user to easily and uniformly and consistently create and maintain the "5 o'clock shadow" look with either a manual, disposable razor or an electric trimmer. Referring to FIG. 14, the cap 30 may be snapped or removably secured to the rear of the blade head in an in-storage position.

Figure 12:
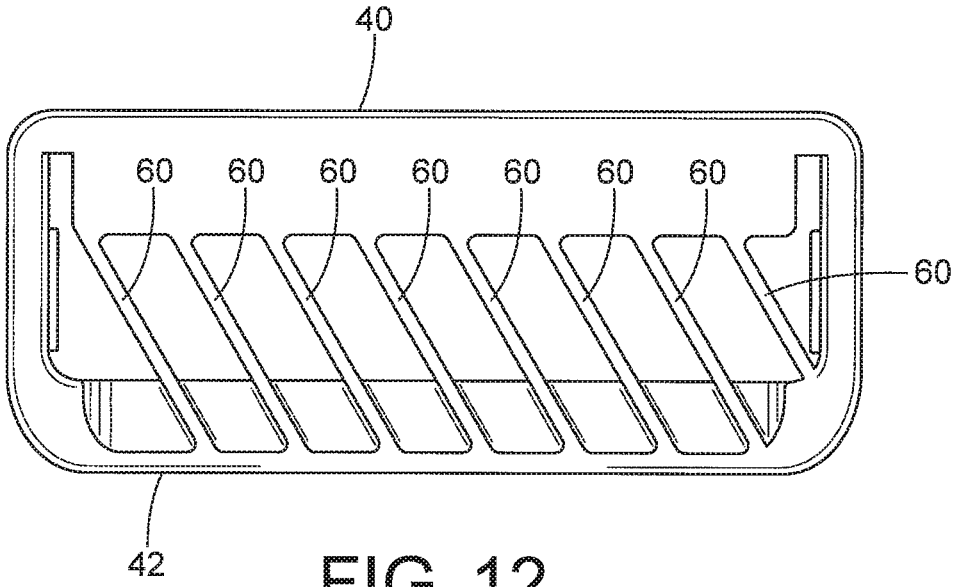
FIG. 12 is a top plan view of a cap with angled ribs at a 45 degree angle in accordance with another embodiment of the disclosure.
Figure 13:
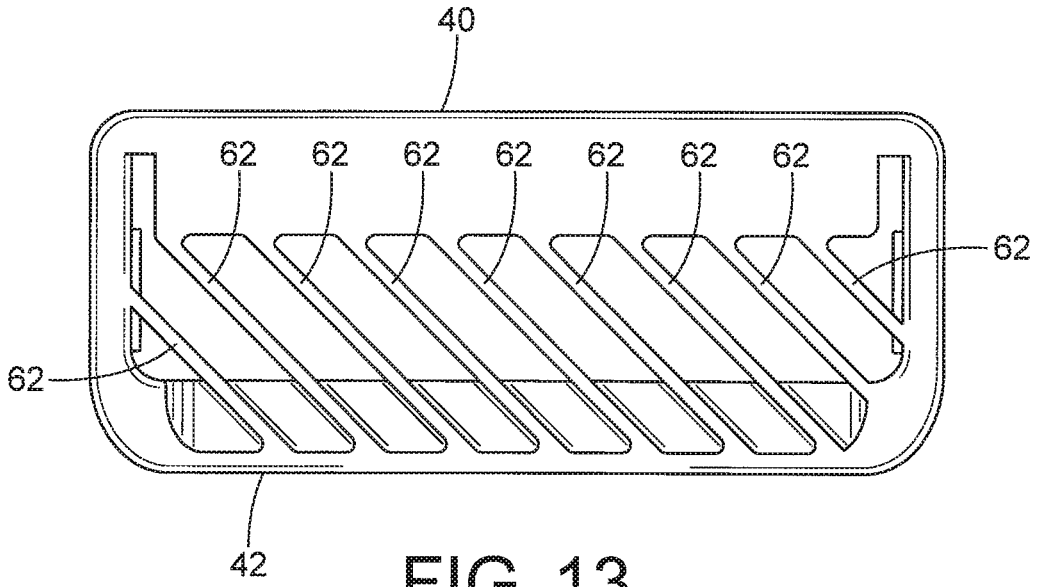
FIG. 13 is a top plan view of a cap with angled ribs at a 60 degree angle in accordance with another embodiment of the disclosure.

Referring to FIG. 12, in accordance with another embodiment of the disclosure, the ribs 60 may be angled at 45 degrees with respect to walls 40, 42. Referring to FIG. 13, the ribs 62 may be angled at 60 degrees with respect to walls 40, 42. By angling the ribs, a smoother shave may occur and possible bald spots can be minimized on the user's face.

The caps can also be adjustable and can be hinged or rotatably connected to the blade such that the cap can be rotated into position over the blade when the 5 o'clock shadow shave is desired and then be rotated away from the blade so the blade can perform a close shave on the other areas of the user's face.

The caps can be provided separately, as a disposable, and as well as with a variety of item commercially available razors, such as Gillette®, Harry's®, Schick®, Dollar Shave Club®, etc. and can also be provided with the razor and blade.

The cap can also be provided directly on the blade head or can be formed as part of the blade head for a particular gauge beard thickness as a complete, disposable unit including the blade head and handle. The cap also can be removable and reusable.

The embodiments discussed above are illustrative only. Various other embodiments are encompassed by and contemplated by the disclosure and the appended claims.

The invention claimed is:

1. A razor assembly comprising;

a spacer configured to be attached to a blade assembly of a razor assembly during shaving, wherein the spacer is used to adjust a blade depth by spacing the blade assembly from a skin surface, the spacer comprising:

a top wall and a bottom wall, wherein the bottom wall defines a skin engagement surface;

a first side wall and a second side wall, wherein the first side wall and the second side wall connect the top wall to the bottom wall at opposite ends;

a plurality of tapered-depth ribs configured to define a variable distance between one or more cutting blades and a skin surface, wherein the each of the plurality of tapered-depth ribs traverse between the top wall and the bottom wall; each of the plurality of taper-depth ribs includes a top skin engagement surface and a bottom surface, each top skin engagement surface and bottom surface having a flat portion and a smooth curved portion, wherein a length of the flat portion of the top skin engagement surface is greater than a length of the flat portion of the bottom surface, wherein a thickness of each of the plurality of taper-depth ribs varies along the length of the curved portion of the top skin engagement surface in relation to the bottom curved surface, wherein each of the first side wall and the second side wall comprises a fastener between the top and bottom walls that facilitates removeable attachment of the spacer to the blade assembly, and wherein the plurality of tapered-depth ribs are not parallel to the first and second side walls.

2. The razor assembly of claim 1, wherein each of the fasteners is a resilient clip that secures the spacer to the blade assembly.

3. The razor assembly of claim 1, wherein each of the fasteners facilitates one of clip-, snap- or slide-effected attachment of the spacer to the blade assembly.

4. The razor assembly of claim 1, wherein the plurality of ribs define a plurality of cavities having a vertical dimension between the top wall and the bottom wall and a horizontal dimension defined by a distance parallel to the top wall and the bottom wall, wherein at least one of the plurality cavities has a size differing from the others of the plurality of cavities.

5. The razor assembly of claim 1, wherein the blade assembly is removably attached to a handle.

6. The razor assembly of claim 1, wherein the spacer is a cap which is adapted to space a cutting edge of the blade assembly from the skin surface.

7. The razor assembly of claim 6, wherein the fastener facilitates slidable attachment of the cap to the blade assembly.

8. The razor assembly of claim 6, wherein the cap is tapered between the top wall and the bottom wall.

9. The razor assembly of claim 1 wherein each of the plurality of tapered-depth ribs has a beginning thickness in a range of 0.1 mm to 0.4 mm and an ending thickness in a range of 0.1 mm to 0.4 mm and are adapted to create a shaved hair length in the range of 0.1 mm to 0.4 mm.

* * * * *